United States Patent [19]

Smith et al.

[11] 4,453,276

[45] Jun. 12, 1984

[54] DISPOSABLE PROTECTIVE HEADWEAR AND PROCESS AND APPARATUS FOR ITS PRODUCTION

[75] Inventors: Rory J. M. Smith, Hebden; Brenda M. Sykes, Cross Hill; Roger S. Terry, Kenton, all of England

[73] Assignee: Johnson & Johnson, New Brunswick, N.J.

[21] Appl. No.: 287,833

[22] Filed: Jul. 29, 1981

[30] Foreign Application Priority Data

Jul. 31, 1980 [GB] United Kingdom ..... 8025014

[51] Int. Cl.[3] ..... A42B 1/04

[52] U.S. Cl. ..... 2/195; 2/63

[58] Field of Search ..... 2/195, 198, 192, 194, 2/200, 63

[56] References Cited

U.S. PATENT DOCUMENTS

| | | | |
|---|---|---|---|
| 625,776 | 5/1899 | Von Klein | 2/195 |
| 640,436 | 1/1900 | Anderson | 2/192 |
| 3,523,303 | 8/1970 | Wagenfeld | 2/200 |
| 3,872,516 | 3/1975 | Bind et al. | 2/200 |

FOREIGN PATENT DOCUMENTS

| | | | |
|---|---|---|---|
| 106469 | 2/1967 | Denmark | 2/195 |
| 772288 | 4/1957 | United Kingdom . | |
| 1030093 | 5/1966 | United Kingdom | 2/195 |

*Primary Examiner*—Doris L. Troutman

[57] ABSTRACT

This invention relates to an item of disposable protective headwear, particularly surgical headwear. The headwear has a crown-piece formed from a rectangular sheet of nonwoven fabric, e.g . a viscose rayon nonwoven fabric, having a pair of opposed side edges and a pair of opposed end edges. The sheet is pleated along longitudinal foldlines parallel to the opposed pair of side edges, and at least some of the pleats are secured together at each end of the pleated sheet. The opposed side edges being secured to a head-band of nonwoven fabric provided with tie-strings. In one embodiment of the invention there is provided a surgeons cap and a in another a surgeons hood. The invention also provides a method and apparatus for producing disposable protective headwear and in particular a method and apparatus for continuous production of disposable protective headwear.

15 Claims, 8 Drawing Figures

DISPOSABLE PROTECTIVE HEADWEAR AND PROCESS AND APPARATUS FOR ITS PRODUCTION

This invention relates to disposable protective headwear, especially disposable surgical headwear, and a process and apparatus for its production.

Disposable, i.e. single-use, surgical headwear is now in common use. Its function is securely to contain the hair and thereby prevent hair and skin particles from contaminating the patient. A well-known disposable theatre cap is made of nonwoven fabric and comprises an oval crown-piece to which is stitched a strip constituting a head-band which is extended rearwardly of the crown-piece to constitute tie-strings for tying the cap at the back of the head. A well-known disposable surgeon's hood is of somewhat similar construction except that the head-band is deeper and shaped as a cowl, the tie-strings extending from the mandibular region of the cowl for passing under the chin and tying at the back of the neck.

The production of this theatre cap and surgeon's hood is wasteful of fabric as ovals of fabric are cut from a nonwoven fabric web leaving unusable areas of fabric therebetween. Moreover, the stitching together of the two pieces of fabric requires the matching of edges and is a precision operation which has to be effected by skilled machinists. This naturally leads to some variation in the size of the product and is labour intensive.

The present invention provides an item of disposable protective headwear, particularly surgical headwear, having a crown-piece formed from a rectangular sheet of nonwoven fabric having a pair of opposed side edges and a pair of opposed end edges, said sheet being pleated along longitudinal fold-lines parallel to said opposed pair of side edges, at least some of the pleats being secured together at each end of said pleated sheet, and the opposed side edges being secured to a head-band of nonwoven fabric provided with tie-strings.

The crown-piece of disposable protective headwear particularly surgical headwear, in accordance with the present invention is made of a rectangular sheet of nonwoven fabric which may be cut from a web thereof without waste. Moreover the headwear lends itself to automatic production, no skilled operatives being required for its production. This leads to uniformity in the size of the product.

The term "rectangular" as used in this Specification means precisely or substantially rectangular.

In one embodiment of the present invention, the item of surgical headwear is a theatre cap. All the pleats at the forward end of the cap may be secured together, but only some, centrally located, pleats at the rearward end of the cap may be secured together, so that the crown-piece can be widened out at the rearward end.

In another embodiment of the present invention, the item of surgical headwear is a surgeon's hood. All the pleats at each end of the sheet may be secured together, so that the crown-piece can be widened out to a maximum between said ends.

The nonwoven fabric may comprise natural and/or man-made fibers, e.g. cellulosic fibers, or synthetic fibers. Paper may be employed as the nonwoven fabric. However the nonwoven fabric is preferably a viscose rayon nonwoven fabric. The nonwoven fabric may consist of, or include, other textile fibers, especially when a heat-sealable fabric is required. For example, suitable heat-sealable fibers are polyehtylene-coated polypropylene fibers sold by the Chisso Corporation of Japan.

The nonwoven fabric may be rearranged or "bundled" nonwoven fabric, e.g. "KEYBAK" bundled nonwoven fabric or may be a plain nonwoven fabric. Alternatively it could be a random laid nonwoven fabric.

The opposed side edges and the pleats may be secured by stitching, but other methods of securement may be employed, for example, bonding using a hot-melt adhesive, heat-sealing (when the nonwoven fabric comprises heat-sealable fibers), and ultrasonic or dielectic welding. Other methods of securement such as stapling may be used.

Preferably, the tie-strings are integral with the head-band in the protective headwear of the present invention.

The present invention further provides a method of producing disposable protective headwear, particularly disposable surgical headwear, comprising the steps of forming a crown-piece by pleating a rectangular sheet of nonwoven fabric along longitudinal fold-lines parallel to opposed side edges of said sheet, securing together at least some of the pleats at each end of the pleated sheet, and securing a head-band to said opposed side edges.

In the method of the present invention, the securing of the pleats may be effected prior to or simultaneously with the securing of the side edges to the head-band.

The method according to the present invention may be a continuous one, and according to this aspect of the present invention there is provided a method of producing disposable protective headwear, particularly disposable surgical headwear, comprising the steps of advancing a web of nonwoven fabric to a pleating station, pleating said web along longitudinal fold-lines parallel to the opposed side edges of said web, compacting the pleats together, securing together at least some of the pleats at each end of a length of said pleated web, severing said length from said web, and securing a head-band to the side edges of said length.

The head-band may be secured to said side edges before or after the length is severed from the web.

The present invention even further provides apparatus for producing disposable protective headwear, particularly disposable surgical headwear, comprising folding means for pleating a rectangular sheet of nonwoven fabric along longitudinal fold-lines parallel to opposed side edges of said sheet, means for securing together at least some of the pleats at each end of the pleated sheet, and means for securing a head-band to opposed side edges of the pleated sheet.

Preferred apparatus in accordance with the present invention is arranged to form a production line, and according to this aspect of the present invention, the apparatus comprises means for advancing a web of nonwoven fabric to a pleating station, means at said pleating station for pleating said web along longitudinal fold-lines parallel to opposed side edges of said web, means for compacting the pleats together, means for securing together at least some of the pleats of a length of said pleated web at each end of said length, means for severing said length from said web, and means for securing a head-band to the side edges of said length.

The pleating means may be a folding plate comprising a plurality of guides which are a series of flat sheets progressively intermeshed towards the downstream end so as gradually to develop pleats in the web. The guide spacing is reduced progressively so as to cause the pleats of the web to come closer together as the web advances through the folding plate.

The compacting means may comprise a pair of nip rolls.

Preferred embodiment of disposable surgical headwear and a process and apparatus for the production thereof will now be described, by way of example, with reference to the accompanying diagrammatic Drawings, in which.

In the Drawings, like reference numerals indicate the same or similar parts.

Referring to FIGS. 1 to 4 of the Drawings, the disposable theatre cap, shown generally at 1, comprises two pieces of nonwoven fabric, namely a crown-piece 2 and a head-band 3 secured thereto, the head-band 3 extending rearwardly of crown-piece 2 to provide a pair of integral tie-strings 4 for securing the cap 1 to the wearer.

Figure 2:
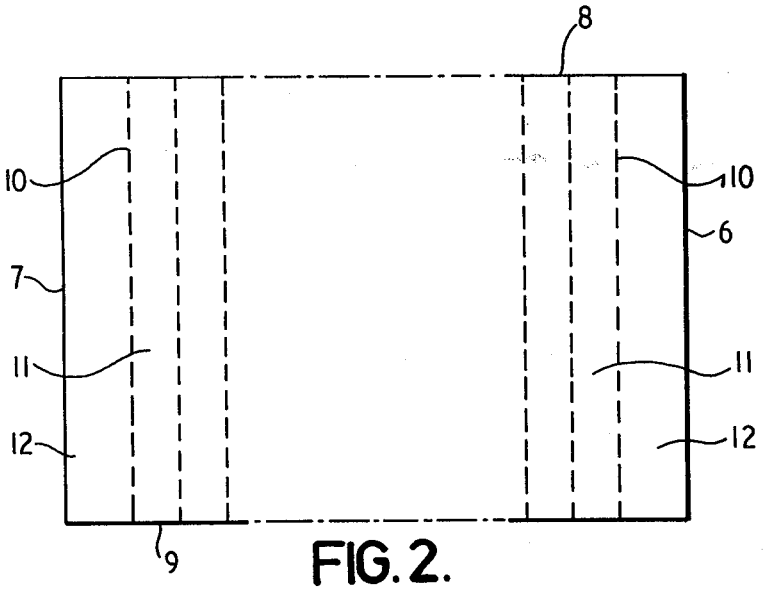
FIG. 2 is a plan view of a sheet of nonwoven fabric from which the crown-piece of the cap of FIG. 1 is formed.

The crown-piece 2 is formed from a rectangular sheet 5 of nonwoven fabric shown in FIG. 2. The sheet 5 has a pair of opposed side edges 6, 7 and a pair of opposed end edges 8, 9. Longitudinal fold-lines 10 parallel to said side edges 6, 7 are shown in outline extending longitudinally of the sheet 5, to define the precursors of inner pleats 11 and two outer pleats 12 which are slightly wider than the inner ones 11.

Figure 3:
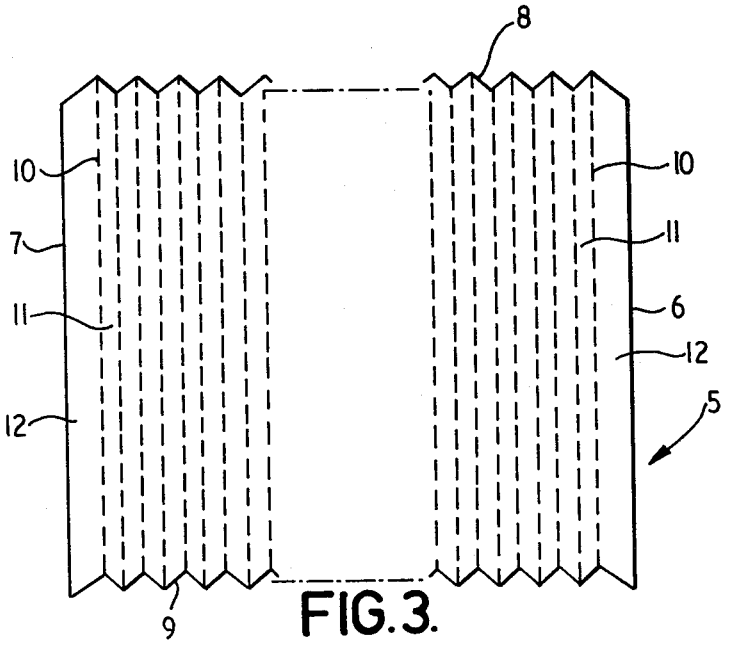
FIG. 3 is a view of said sheet after creasing.
Figure 4:
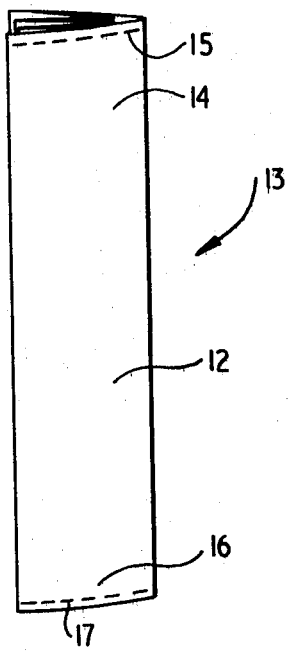
FIG. 4 is a view of said sheet after pleating, compacting and stitching.

As shown in FIG. 3, the sheet 5 is creased along the longitudinal fold-lines 10 to provide the pleats 11, 12 proper as shown in FIG. 4. The pleats 11, 12 are compacted together and secured to form a blank shown generally at 13. In the blank 13, the pleats 11, 12 are secured together at the upper end 14 by stitching 15 near the end edge 8. Only some of the pleats 11, namely those in the centre of the blank, are secured together at the lower end 16 of the blank 13 by stitching 17 near the end edge 9. Thus the blank 13 can be widened out to some extent at the lower end 16, but cannot be widened out at the upper end 14. This blank 13 is used as the crown-piece 2 in the disposable theatre cap 1 of FIG. 1.

Figure 1:
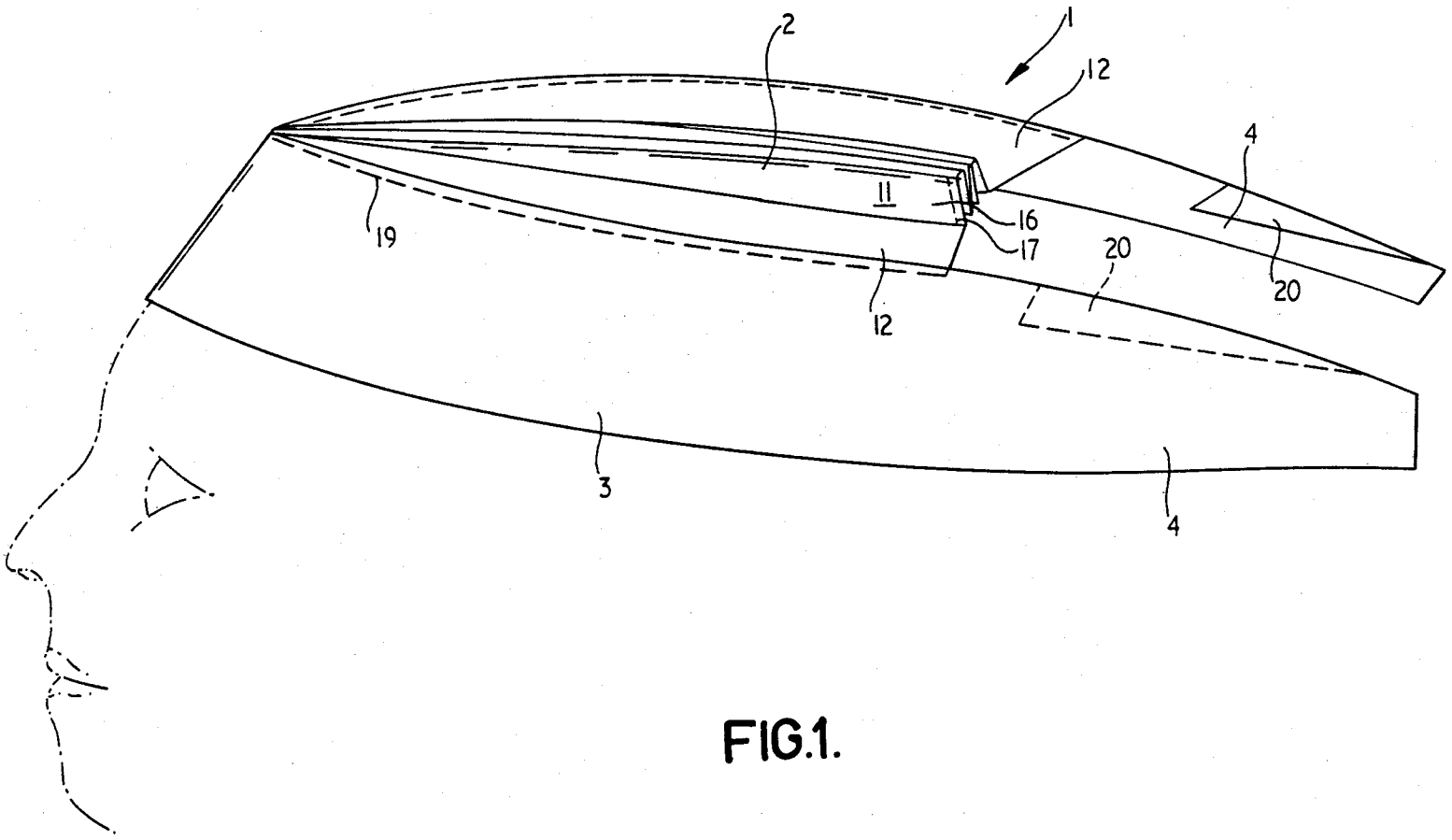
FIG. 1 is a perspective view of a disposable theatre cap.

To produce the cap 1, there is secured by stitching 19 to the blank 13 a length of, e.g., rectangular nonwoven fabric (not shown in FIG. 4) constituting the head-band 3. This length is secured to, and extends around, the upper end 14 of the blank (the forward end in the cap 1), along side edges 6, 7 and beyond the lower end 16 (the rearward end in the cap 1), as shown in FIG. 1. The rearwardly extending portions of the head-band 3 constituting the tie-strings 4 are partly doubled over at 20 and secured, as by stitching, in the manner shown, to narrow the tie-strings 4, so that they can be more readily tied at the back of the head.

Figure 5:
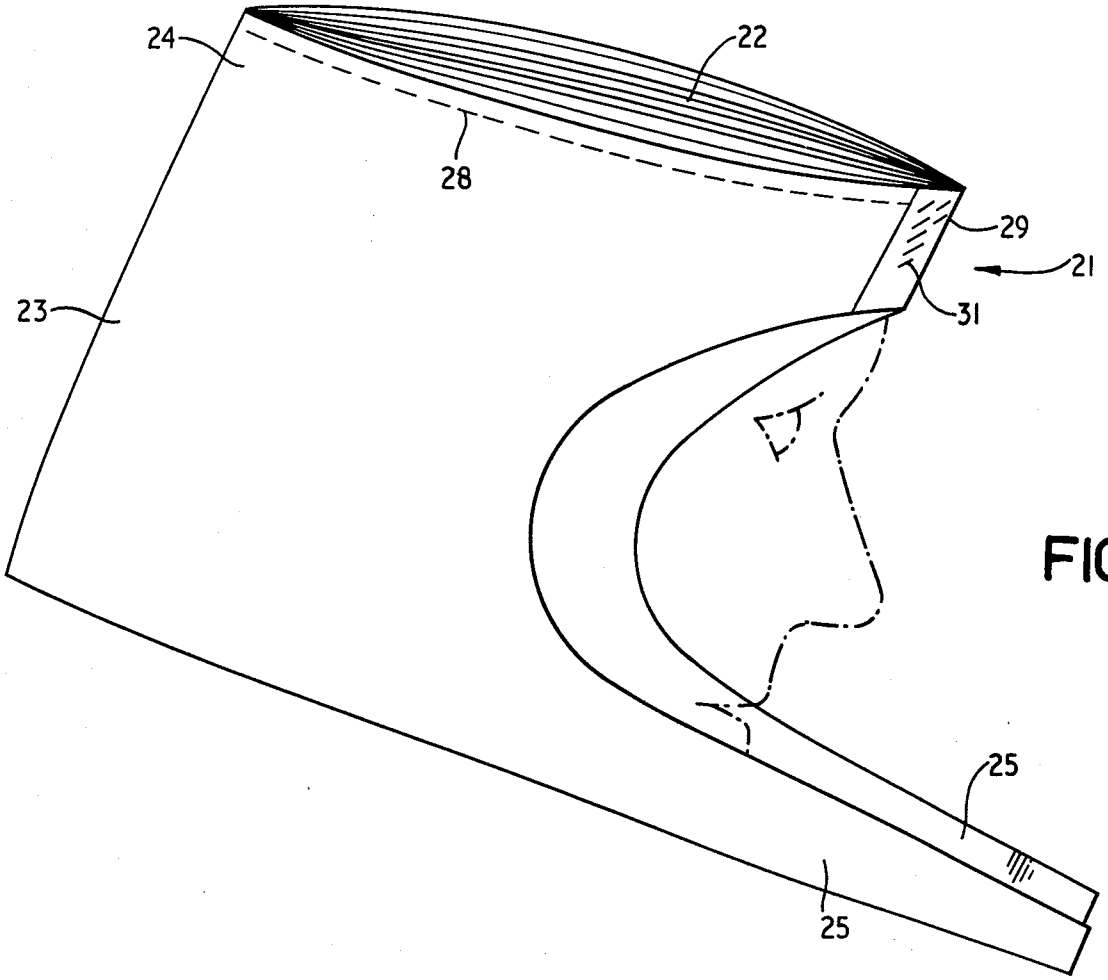
FIG. 5 is a perspective view of a disposable surgeon's hood.

Referring now to FIG. 5 of the Drawings, the disposable surgeon's hood, shown generally at 21, comprises two pieces of nonwoven fabric, namely a crown-piece 22 and a cowl 23 secured thereto.

The crown-piece 22 is as shown in FIGS. 2 to 4 except that all the pleats 11, 12 are secured together at each end 14, 16 of the blank 13.

The cowl 23 comprises a head-band 24 extended downwardly as shown to cover the head leaving only the face exposed. A pair of integral tie-strings 25 extends forwardly from the mandibular region of the cowl 23 and can be passed under the chin and tied at the back of the neck to secure the hood 21 to the wearer.

Figure 6:
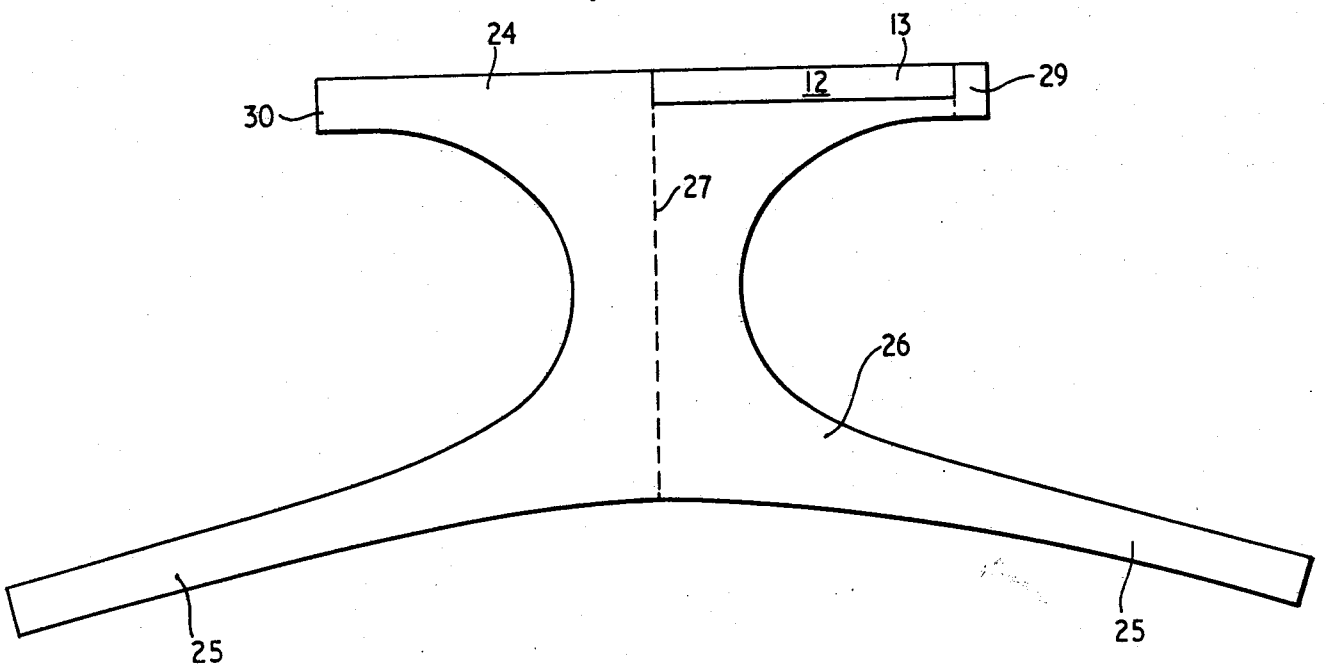
FIG. 6 is a plan view of a head-band blank for use in the surgeon's hood of FIG. 5.

As shown in FIG. 6, the cowl 23 is formed from a blank 26 which is folded about dotted line 27 around the blank 13 and secured to the side edges 6, 7 thereof by stitching 28. The portion 29 of the head-band 24 extending beyond the blank 13 is folded back over the other end 30 of the head-band 24 and secured thereto by stitching 31.

The theatre cap 1 and surgeon's hood 21 are used in a similar manner to known disposable headwear. They are comfortable to wear, and remain in place on the head during use.

A suitable lightweight, conformable, nonwoven fabric for the theatre cap 1 and surgeon's hood 21 is "KEYBAK" bundled nonwoven fabric having a weight of about 10 to 50, e.g. about 30 to 35 g/m$^2$. This fabric is a viscose rayon fabric bonded by an acrylic binder. The width of sheet 2 from which the crown-piece of the disposable surgical headwear is formed may be about 28.5 cms, and the length of about 24 cms.

Figure 7:
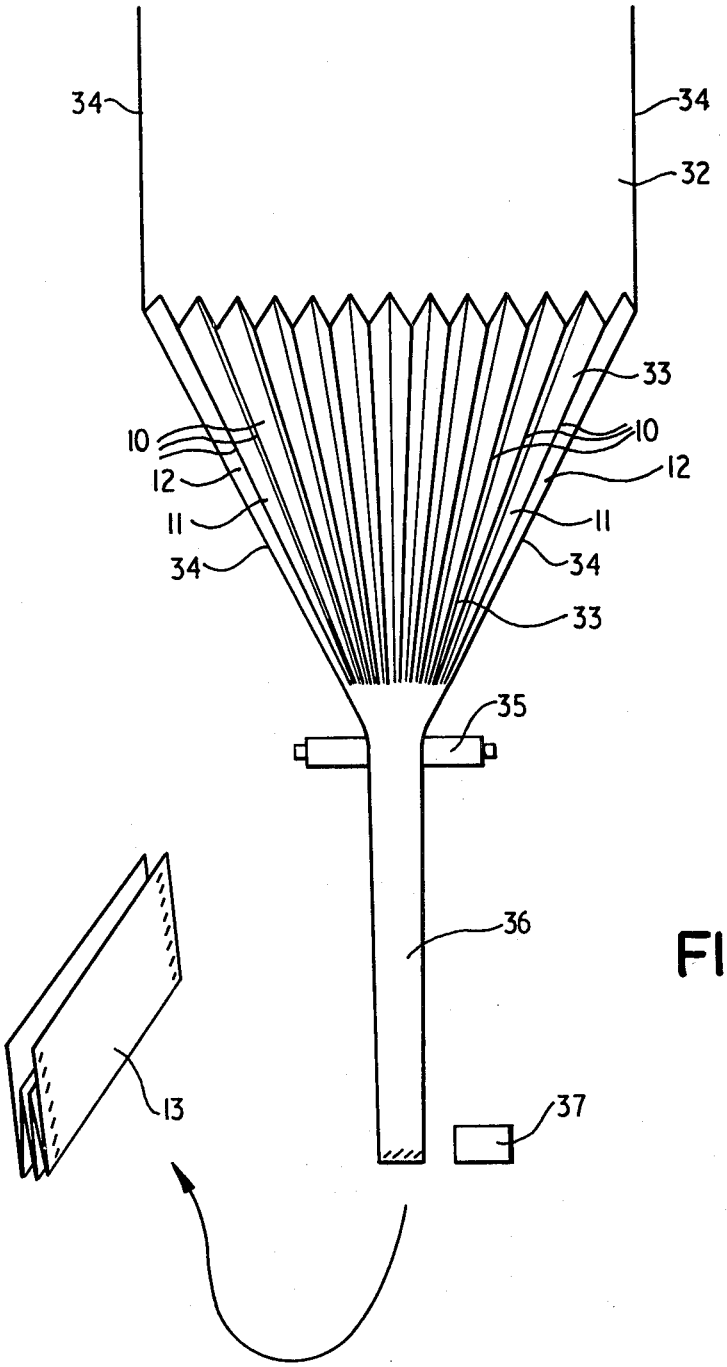
FIG. 7 depicts a flow-line for the production of the surgical headwear.

The disposable theatre cap 1 and surgeon's hood 21 may be produced automatically using the method and apparatus described hereinafter with reference to FIGS. 7 and 8.

A flat non-tubular web 32 of nonwoven fabric as above described having a width of about 24 cms is continuously advanced from a bulk roll thereof (not shown ) to a pleating station at which is stationed a folding plate 33, shown partly cut-away to expose web 32, as described hereinafter in greater detail with reference to FIG. 8. At the pleating station the web is creased along fold-lines 10 parallel to the longitudinal edges 34 of the web 32, the individual pleats 11, 12 being brought closer together as the web 32 advances through the folding plate 33.

The pleated web is then turned through 90° and passed through a pair of nip rolls 35 to compact the pleated web into a continuous narrow blank 36. The rolls 35 also serve to advance the web 32 through the apparatus.

The continuous blank 36 is then advanced by rolls 35 to a sewing station at which the pleats 11, 12 at one end of the blank 36 are secured together transversely of the blank 36 by a traversing sewing head 37. After advancing a predetermined length of the blank 36 past the sewing head 37, some of the inner pleats 11 are again stitched together transversely of the blank 36 by the sewing head 37. A guillotine, not shown, then severs the continuous blank 36 just upstream of the second line of transverse stitching to provide a blank 13 as shown in FIG. 4. It will be appreciated that the apparatus may be operated continuously.

Figure 8:
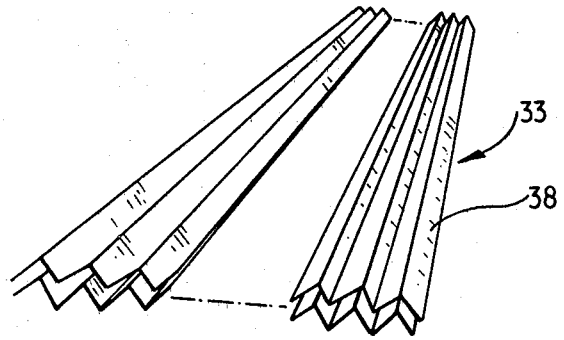
FIG. 8 is a perspective view of a folding plate for use in the flow-line of FIG. 7.

An example of the folding plate 33 is shown in greater detail in FIG. 8 and comprises a plurality of guides 38. Guides 38 comprise a series of flat sheets progressively intermeshed towards the downstream end of the folding plate 33 so as gradually to develop pleats on the web 32. The guide spacing is reduced progressively so as to cause the pleats 11, 12 to come closer together as the web 32 advances through the folding plate 33.

The production method described above does not result in any waste of the nonwoven fabric web. All stitching is in straight lines which is easily effected by machinery, and no skilled operatives are required in the production method. Other methods of securing the fabric together instead of stitching may be employed as, for example, bonding by a hot-melt adhesive.

The attachment of an appropriate head-band may be effected before or after the blank 13 is severed from the continuous blank 36.

Although the present invention has been particularly described above with reference to surgical headwear, it will be understood that the protective headwear of the present invention may be used in environments other than the operating theatre as, for example, laboratories and in the electronics, pharamaceutical, and food industries.

What is claimed is:

1. An item of disposable protective headwear having a crown-piece formed from a rectangular sheet of nonwoven fabric having a pair of opposed side edges and a pair of opposed end edges, said sheet being pleated to form a plurality of pleats along longitudinal fold-lines parallel to said opposed pair of side edges, all the pleats at one end of the pleated sheet are secured together, but only some, centrally located, pleats at the other end are secured together, and the opposed side edges being secured to a head-band of nonwoven fabric provided with tie-strings.

2. An item as claimed in claim 1 wherein the tie-strings are integral with the head-band.

3. An item as claimed in claim 1 wherein the side edges and the pleats are secured by stitching, holt-melt adhesive, heat sealing, or ultrasonic or dielectric welding.

4. An item as claimed in claim 1 wherein the nonwoven fabric is a rearranged or bundled nonwoven fabric, plain nonwoven fabric, or a random laid nonwoven fabric.

5. An item as claimed in claim 1 wherein the nonwoven fabric is a viscose rayon nonwoven fabric.

6. An item as claimed in claim 1 wherein the nonwoven fabric is paper.

7. An item as claimed in claim 1 wherein the nonwoven fabric includes heat-sealable fibres.

8. An item as claimed in claim 7 wherein the fibres are polyethylene-coated polypropylene.

9. An item as claimed in claim 1 wherein the nonwoven fabric has a weight of about 10 to 50 g/m$^2$.

10. An item as claimed in claim 9 wherein the headwear is a cap.

11. An item as claimed in claim 9 wherein the head-band is in the form of a cowl and the headwear is a hood.

12. A method of producing an item of disposable protective headwear comprising the steps of forming a crownpiece by pleating a rectangular sheet of nonwoven fabric along longitudinal fold-lines parallel to opposed side edges of said sheet, securing together all of the pleats at one end of the pleated sheet, securing together the central pleats of the second end of the pleated sheet, and securing a head-band to said opposed side edges.

13. A method as claimed in claim 12 wherein the securing of the pleats is effected prior to or simultaneously with the securing of the side edges to the head-band.

14. A method of producing an item of disposable protective headwear comprising the steps of advancing a web of nonwoven fabric to a pleating station, pleating said web along longitudinal fold-lines parallel to the opposed side edges of said web, compacting the pleats together, securing together all of the pleats at one end of a length of said pleated web, and securing together the centrally located pleats at the second end of said length of pleated web, severing said length from said web, and securing a head-band to the side edges of said length.

15. A method as claimed in claim 14 wherein the head-band is secured after the length is severed from the web.

* * * * *